US006109141A

United States Patent [19]

Nurmi

[11] Patent Number: 6,109,141

[45] Date of Patent: Aug. 29, 2000

[54] BIASING STRUCTURE FOR RATCHET WRENCH PAWL

[75] Inventor: William A. Nurmi, Racine, Wis.

[73] Assignee: Snap-on Tools Company, Kenosha, Wis.

[21] Appl. No.: 09/267,157

[22] Filed: Mar. 12, 1999

[51] Int. Cl.[7] ..... B25B 13/46

[52] U.S. Cl. ..... 81/63; 81/60

[58] Field of Search ..... 81/63, 62, 61, 81/60; 267/160, 166.1, 179, 172

[56] References Cited

U.S. PATENT DOCUMENTS

| | | | |
|---|---|---|---|
| Re. 19,287 | 8/1934 | Pfauser . | |
| 1,380,643 | 6/1921 | Eagle . | |
| 1,722,723 | 7/1929 | Walker . | |
| 1,807,134 | 5/1931 | Pfauser . | |
| 1,834,909 | 12/1931 | Wilson . | |
| 1,927,844 | 9/1933 | Pfauser . | |
| 2,190,081 | 2/1940 | Pfauser . | |
| 2,427,153 | 9/1947 | Mossberg | 81/63 |
| 2,471,593 | 5/1949 | Toye . | |
| 2,538,919 | 1/1951 | Shaff . | |
| 2,630,730 | 3/1953 | Thornton . | |
| 3,039,340 | 6/1962 | Livermont | 81/177.85 |
| 3,372,611 | 3/1968 | Amanti et al. | 81/60 |
| 4,236,266 | 12/1980 | Hannah et al. . | |
| 4,631,988 | 12/1986 | Colvin | 81/62 |
| 4,962,682 | 10/1990 | Rose et al. . | |
| 4,967,624 | 11/1990 | Farris | 81/63 |
| 5,109,737 | 5/1992 | Raber . | |
| 5,255,578 | 10/1993 | Liou . | |
| 5,255,993 | 10/1993 | Kovacs . | |
| 5,387,048 | 2/1995 | Kuo . | |
| 5,694,815 | 12/1997 | Biber et al. . | |
| 5,836,220 | 11/1998 | Valente | 74/650 |

FOREIGN PATENT DOCUMENTS 15526 of 1908 United Kingdom ..... 81/63

OTHER PUBLICATIONS

Snap–on Sealed Ratchet Repair Instructions, Form ZRKS6/3, printed in Jan. 1991.

*Primary Examiner*—David A. Scherbel
*Assistant Examiner*—Hadi Shakeri
*Attorney, Agent, or Firm*—Seyfarth, Shaw

[57] ABSTRACT

A biasing structure for maintaining a pawl in engagement with a toothed gear of a ratchet wrench is provided. The structure includes an elongated plunger having an axis, a pawl engagement end, a spring insertion portion having a free end, a central portion connecting the engagement end to the spring insertion portion, and an annular first shoulder having a shoulder diameter formed between the spring insertion portion and the central portion. The spring insertion portion is tapered from a maximum diameter at the first shoulder to a minimum diameter at the free end. The structure also includes a compression spring coupled to the plunger assembly and having a plurality of coils, wherein at least one of the coils has a diameter less than the shoulder diameter and is disposed about the central portion. A reversible ratchet wrench having a pawl and using the biasing structure is also provided.

15 Claims, 2 Drawing Sheets

BIASING STRUCTURE FOR RATCHET WRENCH PAWL

BACKGROUND OF THE INVENTION

1. Field of the Invention

The present invention relates to hand tools, and more particularly, to ratchet wrenches.

2. Description of the Prior Art

Prior reversible ratchet wrenches typically include a pawl resiliently engaged with a gear coupled to a square drive member. When the pawl is engaged with the tooth gear, a user can only rotate the handle relative to the gear or square drive in one direction. The pawl is engaged by a spring disposed in a bore of the body of the wrench and an unconnected ball at an end of the spring. Often, when the wrench is being assembled or disassembled, the unconnected ball biased by the spring will pop free from the tool. This causes lost time in assembly and, often, the loss of the ball.

In other applications, springs have been coupled to locking structure. For example, a spring coil has been connected to a narrow, circumferential groove in the cylindrical body portion of a lock pin for forming a releasable lock to maintain a detachable wrench head coupled to my associated handle. Since the body portion of the lock pin is cylindrical, it is difficult to insert the coil of the spring into the groove and, since the groove is narrow, only one coil can be accommodated in the groove, possibly making the connection between the spring and lock pin weak.

SUMMARY OF THE INVENTION

It is a general object of the invention to provide an improved biasing structure for the pawl of a ratchet wrench which avoids the disadvantages of prior biasing structures while affording additional structural and operating advantages.

An important feature of the invention is the provision of a biasing structure which is of relatively simple and economical structure.

Another feature of the invention is the provision of a structure of the type set forth which makes ratchet wrench assembly and repair quick and easy.

A further feature of the invention is the provision of a biasing structure of the type set forth, which is safer and less prone to separation and loss.

Certain ones of these and other features of the invention may be attained by providing a biasing structure for maintaining a pawl in engagement with a gear of a ratchet wrench. The structure includes an elongated plunger having an axis, a pawl engagement end, a spring insertion portion having a free end, a central portion connecting the engagement end to the spring insertion portion, and an annular first shoulder having a shoulder diameter formed between the spring insertion portion and the central portion. The spring insertion portion is tapered from a maximum diameter at the first shoulder to a minimum diameter at the free end. A compression spring is coupled to the plunger and has a plurality of coils, wherein at least one of the coils has a diameter less than the shoulder diameter and is disposed about the central portion.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 3:
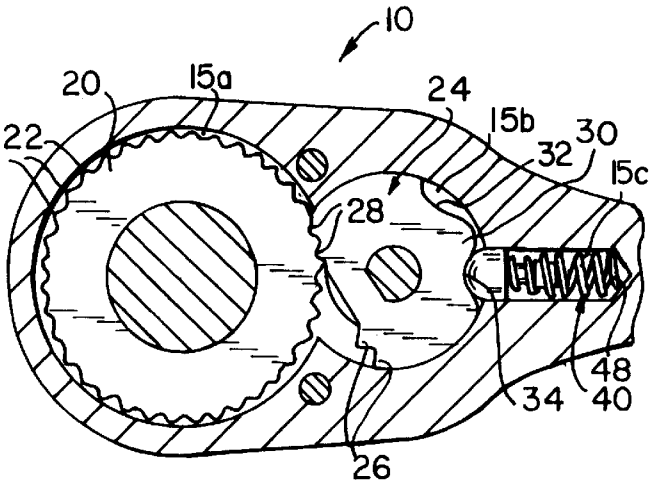
FIG. 3 is a sectional view taken generally along the line 3—3 of FIG. 2.
Figure 4:
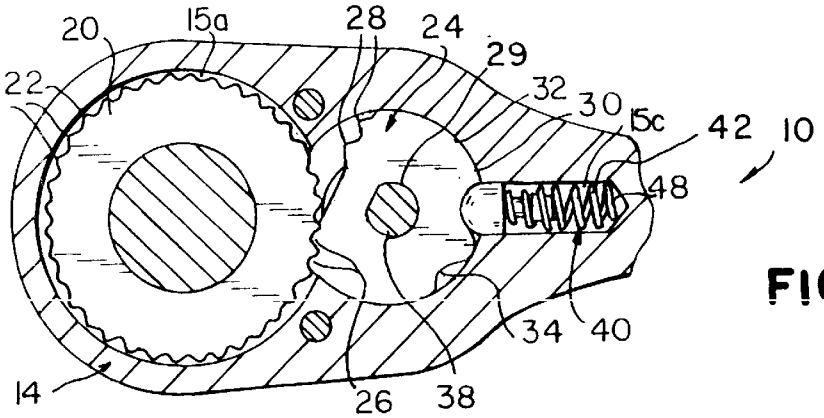
FIG. 4 is a sectional view, similar to FIG. 3, wherein the pawl has been moved to its other position.

Referring to FIGS. 1–4, a reversible ratchet wrench 10 is illustrated. The ratchet wrench 10 includes an elongated handle 12 and a head 14 including first, second and third bores 15*a*–*c* (FIG. 2) communicating with one another, and a ratcheting mechanism 16 disposed therein. The ratcheting mechanism 16 includes a fastener connector in the form of a square 18 having an axis A for connecting to a socket or the like. The square 18 is coupled to a gear 20 disposed in bore 15*a* and having a plurality of teeth 22. The ratcheting mechanism 16 also includes a pawl 24 disposed in bore 15*b*. The pawl 24 is pivotably movable about an axis parallel to axis A. As seen in FIGS. 3 and 4, the pawl 24 has counterclockwise ratcheting teeth 26, clockwise ratcheting teeth 28, a bore 29, and a projection 30 separating a counterclockwise groove 32 from a clockwise groove 34.

A reverse lever 36 is coupled to the pawl 24 by a screw 38 threadedly engaged in the bore 29 of the pawl 24. The reverse lever 36 moves the pawl 24 between forward and reverse ratcheting positions.

Figure 5:
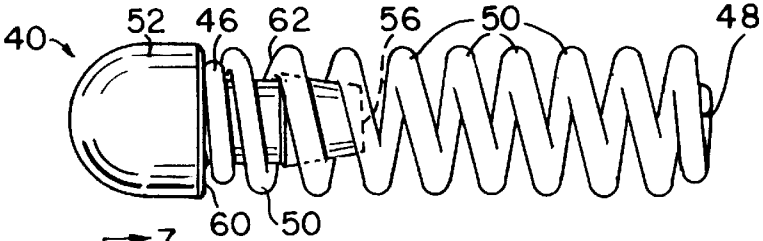
FIG. 5 is an enlarged side elevational view of the spring and plunger assembly of the wrench of FIG. 1.
Figure 6:
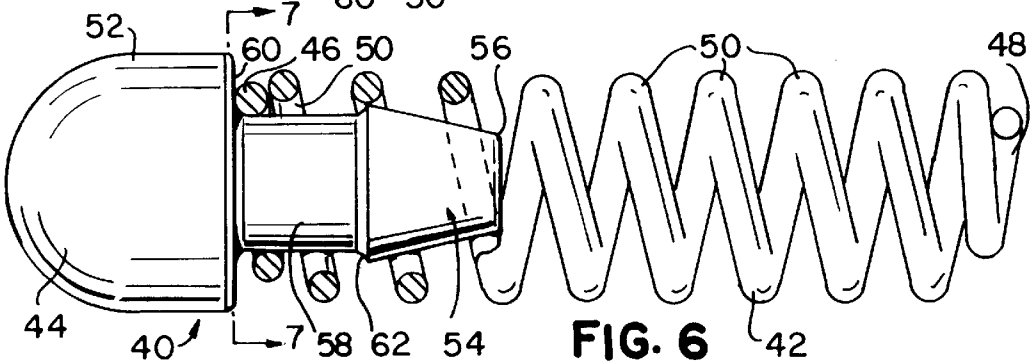
FIG. 6 is a further enlarged view similar to FIG. 5, with portions of the spring coils broken away.
Figure 7:
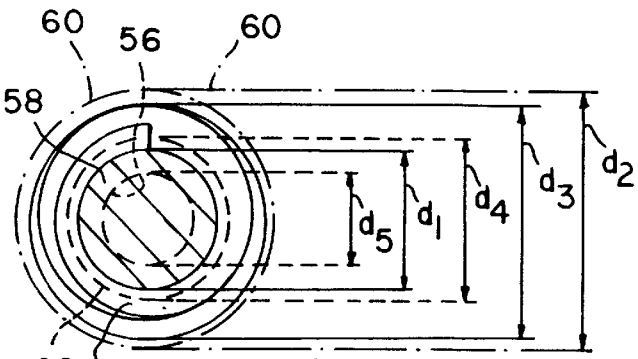
FIG. 7 is a sectional view taken generally along the line 7—7 of FIG. 6.

The ratcheting mechanism 16 also includes biasing structure 40, at least partially disposed in bore 15*c*. As seen best in FIGS. 5 and 6, the biasing structure 40 includes a compression spring 42 and a plunger 44. The spring 42 includes end coils 46, 48 having an inside diameter $d_1$ (see FIG. 7) and a plurality of central coils 50. The central coils 50 have inside and outside diameters respectively greater than the inside and outside diameters of the end coils 46, 48.

The plunger 44 includes a generally bullet-shaped pawl engagement end 52, a generally frustoconical-shaped spring insertion portion 54 having a free end 56, and a cylindrical central portion 58 connecting the pawl engagement end 52 with the spring insertion end 54. An annular shoulder 60 is formed between the central portion 58 and the pawl engagement end 52. The annular shoulder 60 has a diameter $d_2$ greater than the outside diameter $d_3$ of the coils 50 (see FIG. 7). An annular shoulder 62 is also formed between the central portion 58 and spring insertion end 54. The annular shoulder 62 has a diameter $d_4$ (see FIG. 7) greater than the internal diameter $d_1$ of the end coils 46, 48. As discussed above, the spring insertion end 54 is generally frustoconical and has a minimum diameter $d_5$ (see FIG. 7) at its free end 56 and tapers to a maximum diameter at the annular shoulder 62. The diameter $d_5$ of the free end 56 is preferably less than the internal diameter of any of the coils 46–50. This diameter $d_5$ of the free end 56 and the tapering of the spring insertion end 54 allows the plunger 44 to easily be inserted into the coils 46–50 and coupled to the spring 46 by placing the free end 46 through end coil 46, which with resiliently expand until end coil 46 is disposed over shoulder 62 and contacts annular shoulder 60, so that end coil 46 and one or more central coils 50 are disposed about the central portion 58. Since the diameter $d_4$ of the annular shoulder 62 is greater than the internal diameter $d_1$ of the end coil 46, the spring 44 is releasably trapped or coupled to the plunger 44. Since both end coils 46, 48 of the spring 42 have a diameter smaller than annular shoulder 62, the plunger 44 can be inserted at either end of the spring 42 for release coupling to the spring 42.

Figure 1:
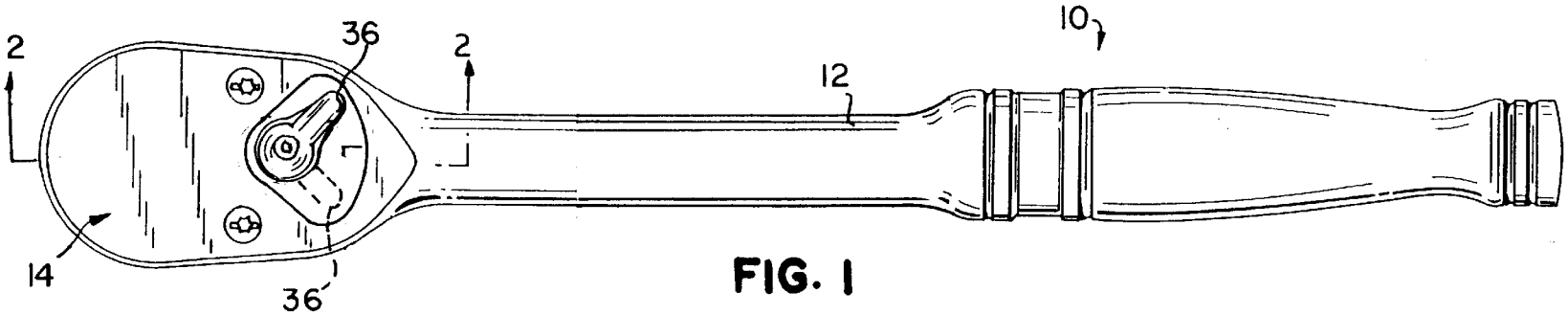
FIG. 1 is a top plan view of the ratchet wrench of the present invention.
Figure 2:
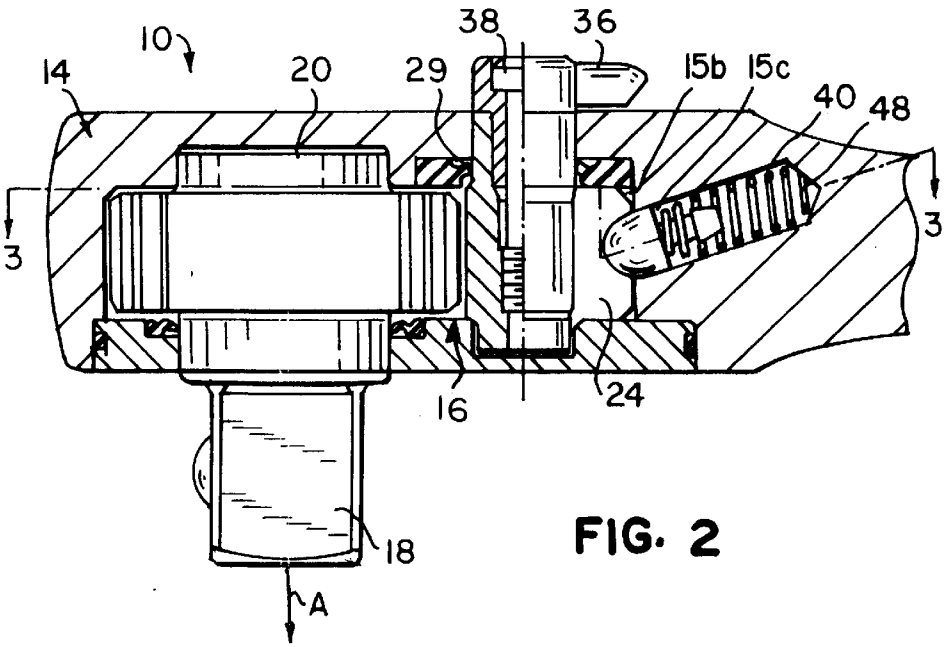
FIG. 2 is a fragmentary sectional view taken generally along line 2—2 of FIG. 1, but with the reversing lever and pawl shown partially in elevation in a first position.

As seen in FIGS. 2–4, the spring 42 (coupled to the plunger 44) is disposed in the bore 15*c* so the end coil 48 contacts the end of the bore 15*c*. As seen in FIG. 3, when the reverse lever 36 is in the position shown in FIG. 1, the pawl engagement end 52 is biased against the clockwise groove 34 of the pawl 24, biasing the clockwise ratcheting teeth 28 against the teeth 22 of the tooth gear 20, allowing the handle 12 to ratchet clockwise.

As seen in FIG. 4, when the reverse lever 36 has been moved to its opposite position, as shown in FIG. 1 by dashed line, the pawl engagement end 52 is biased against the counter-clockwise groove 32, biasing the counter-clockwise ratcheting teeth 26 into engagement with the teeth 22 of the tooth gear 20, thereby allowing the handle 12 to ratchet counterclockwise, all in a known manner.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A biasing structure for maintaining a pawl in engagement with a gear of a ratchet wrench, the structure comprising:

an elongated plunger having an axis, a pawl engagement end, a spring insertion portion having a free end, a central portion connecting the engagement end to the spring insertion portion, and an annular first shoulder having a shoulder diameter formed between the spring insertion portion and the central portion, the spring insertion portion being tapered from a maximum diameter at the first shoulder to a minimum diameter at the free end; and a compression spring coupled to the plunger assembly and having a plurality of coils, wherein at least one of the coils has a diameter less than the shoulder diameter and is disposed about the central portion.

2. The structure of claim 1, wherein the spring insertion portion is substantially frustoconical.

3. The structure of claim 1, wherein the compression spring has first and second ends and first and second end coils respectively disposed at the first and second ends, and a plurality of central coils, wherein the first end coil has a diameter less than that of the central coils.

4. The structure of claim 3, wherein the second end coil has a diameter less than that of the central coils.

5. The structure of claim 1, wherein the diameter of the free end is less than the diameter of any of the coils.

6. The structure of claim 1, wherein the pawl engagement end is generally bullet shaped, and wherein a second shoulder is formed between the pawl engagement end and the central portion, the second shoulder having a diameter greater than the diameter of any of the coils.

7. The structure of claim 6, wherein a plurality of the coils are disposed about the central portion.

8. A ratchet assembly comprising:

a handle;

a fastener connector;

a rotatable gear coupled to the connector and having a plurality of gear teeth;

a pawl coupled to the handle and having pawl teeth engageable with the gear teeth, wherein when the pawl teeth are engaged with the gear teeth, the handle cannot be rotated in a first direction relative to the gear;

a bore disposed in the handle; and biasing structure disposed in the bore including an elongated plunger having an axis, a pawl engagement end engageable with the pawl, a spring insertion portion having a free end, a central portion connecting the pawl engagement end to the spring insertion portion, and a shoulder having a first shoulder diameter formed between the spring insertion portion and the central portion; and a compression spring coupled to the plunger and having a plurality of coils each having a diameter wherein at least one of the coils has a diameter less than the shoulder and is disposed about the central portion.

9. The ratchet assembly of claim 8, wherein the spring insertion portion is tapered from a maximum diameter at the first shoulder to a minimum diameter at the free end.

10. The ratchet of claim 9, wherein the spring insertion portion is substantially frustoconical.

11. The ratchet of claim 9, wherein the compression spring has first and second ends and first and second end coils respectively disposed at the first and second ends, and a plurality of central coils, wherein the first end coil has a diameter less than that of the central coil.

12. The ratchet of claim 11, wherein the second end coil has a diameter less than that of the central coils.

13. The ratchet of claim 9, wherein the minimum diameter at the free end is less than the diameter of any of the coils.

14. The ratchet of claim 9, wherein the pawl engagement end is generally bullet shaped, and wherein a second shoulder is formed between the pawl engagement end and the central portion, the second shoulder having a diameter greater than the diameter of any of the coils.

15. The ratchet of claim 14, wherein a plurality of the coils are disposed about the central portion.

* * * * *